US011366428B2

(12) United States Patent
Avril

(10) Patent No.: US 11,366,428 B2
(45) Date of Patent: Jun. 21, 2022

(54) CROWN/PUSHER FOR TIMEPIECES

(71) Applicant: MECO SA, Grenchen (CH)

(72) Inventor: Hervé Avril, Les Breuleux (CH)

(73) Assignee: MECO SA, Grenchen (CH)

( * ) Notice: Subject to any disclaimer, the term of this patent is extended or adjusted under 35 U.S.C. 154(b) by 0 days.

(21) Appl. No.: 17/029,181

(22) Filed: Sep. 23, 2020

(65) Prior Publication Data

US 2021/0165368 A1 Jun. 3, 2021

(30) Foreign Application Priority Data

Nov. 29, 2019 (EP) ..... 19212451

(51) Int. Cl.
*G04B 3/04* (2006.01)
*G04G 21/00* (2010.01)

(52) U.S. Cl.
CPC ..... *G04B 3/041* (2013.01); *G04G 21/00* (2013.01)

(58) Field of Classification Search
CPC ..... G04B 3/041; G04B 3/046; G04B 3/043; G04B 37/103; G04B 37/04; G04B 19/286; G04B 19/28; G04B 37/06; G04B 27/004; G04G 21/00
USPC ..... 368/319, 308
See application file for complete search history.

(56) References Cited

U.S. PATENT DOCUMENTS 5,521,890 A * 5/1996 Miche ..... G04B 37/106 368/319
7,318,670 B2 * 1/2008 Cretin ..... G04B 3/046 368/308
8,371,745 B2 2/2013 Manni
9,709,955 B2 * 7/2017 Hirayama ..... G04B 27/00
10,613,481 B2 * 4/2020 Iguchi ..... G04B 3/043
11,042,122 B2 * 6/2021 Iguchi ..... G04B 3/041
(Continued)

FOREIGN PATENT DOCUMENTS

CH 703 622 A2 2/2012
CH 708 958 A2 6/2015
(Continued)

OTHER PUBLICATIONS

European Search Report dated Jun. 3, 2020 in European Application 19212451.9 filed Nov. 29, 2019 (with English Translation of Categories of Cited Documents), 3 pages.
(Continued)

*Primary Examiner* — Edwin A. Leon
(74) *Attorney, Agent, or Firm* — Oblon, McClelland, Maier & Neustadt, L.L.P.

(57) ABSTRACT

A crown/pusher including a tube attached to a watch case, a recessed head integral with a stem which is movable with respect to the tube and defines an axis, the recessed head being mounted to move in rotation and in translation respectively around and along the axis of the stem, a return spring disposed around the stem, the crown/pusher includes a cage housing the spring, the cage being traversed by the stem and including an upper part integral with the recessed head and a lower part freely mounted with respect to the recessed head, the upper part cooperating with the lower part in order to drive the lower part in its rotational movement and in order to move in translation along the axis with respect to the lower part, the spring being compressed inside the cage in order to be driven in rotation with the cage.

14 Claims, 4 Drawing Sheets

(56) References Cited

U.S. PATENT DOCUMENTS

| | | | | |
|---|---|---|---|---|
| 2005/0207285 | A1* | 9/2005 | Omori | G04B 37/10 368/319 |
| 2010/0017055 | A1 | 1/2010 | Fisher et al. | |

FOREIGN PATENT DOCUMENTS

| | | | |
|---|---|---|---|
| CH | 714 125 | A2 | 3/2019 |
| CN | 1352908 | A | 6/2002 |
| CN | 101334628 | A | 12/2008 |
| CN | 101334631 | A | 12/2008 |
| CN | 101813912 | A | 8/2010 |
| CN | 102193483 | A | 9/2011 |
| CN | 108241286 | A | 7/2018 |
| CN | 108572541 | A | 9/2018 |
| CN | 109424785 | A | 3/2019 |
| CN | 109426133 | A | 3/2019 |
| CN | 208740679 | U | 4/2019 |
| EP | 1 513 028 | A2 | 3/2005 |

OTHER PUBLICATIONS

Combined Chinese Office Action and Search Report dated Oct. 8, 2021 in Patent Application No. 202011356150.8 (with English translation of Category of Cited Documents), 8 pages.

* cited by examiner

CROWN/PUSHER FOR TIMEPIECES

CROSS-REFERENCE TO RELATED APPLICATION

This application claims priority to European Patent Application No. 19212451.9 filed on Nov. 29, 2019, the entire disclosure of which is hereby incorporated herein by reference.

SUBJECT OF THE INVENTION

The present invention relates to the field of horology and more specifically to an arrangement of a spring inside a crown/pusher.

BACKGROUND OF THE INVENTION AND PRIOR ART

Crown/pushers fitted to timepieces are provided with a return spring which is positioned around the stem of the crown. The spring generally rests at one end under the crown head and at the other end on a shoulder of the crown tube or on a washer arranged on this same shoulder. In use, the relative movement between the spring and the rotating components of the crown/pusher causes a phenomenon of scraping and thereby premature wear of the spring.

To overcome this drawback, U.S. Pat. No. 8,371,745 proposes inserting a washer to facilitate sliding at each end of the spring. Although sliding is facilitated, the relative movement between the washer integral with the crown head and the spring still generates friction which does not allow a continuous drive of the crown.

SUMMARY OF THE INVENTION

It is an object of the present invention to overcome the aforecited drawbacks by proposing a timepiece comprising a spring arranged inside the crown/pusher so as to eliminate friction between the spring and the rotating components.

To this end, the present invention proposes a crown/pusher provided with a spring placed inside a cage integral in rotation with the movement of the head, said spring being arranged inside the cage so as to be driven in rotation with the cage.

This arrangement of the spring inside a cage makes it possible to avoid any scraping between the spring and the recessed bottom of the crown and thereby increases the life of the spring. As the cage rotates with the spring, when an action is performed on the crown/pusher, the spring is not subjected to a relative movement with respect to a component. Further, as the cage has faces of similar shape to those of the faces on which it bears, normal friction is present in the bearing area, which ensures continuous driving of the crown.

The features and advantages of the present invention will appear upon reading the following detailed description, with reference to the following Figures.

DETAILED DESCRIPTION OF THE INVENTION

The present invention relates to a timepiece of the wristwatch type. It may be an electronic watch or a mechanical watch.

Figure 1:
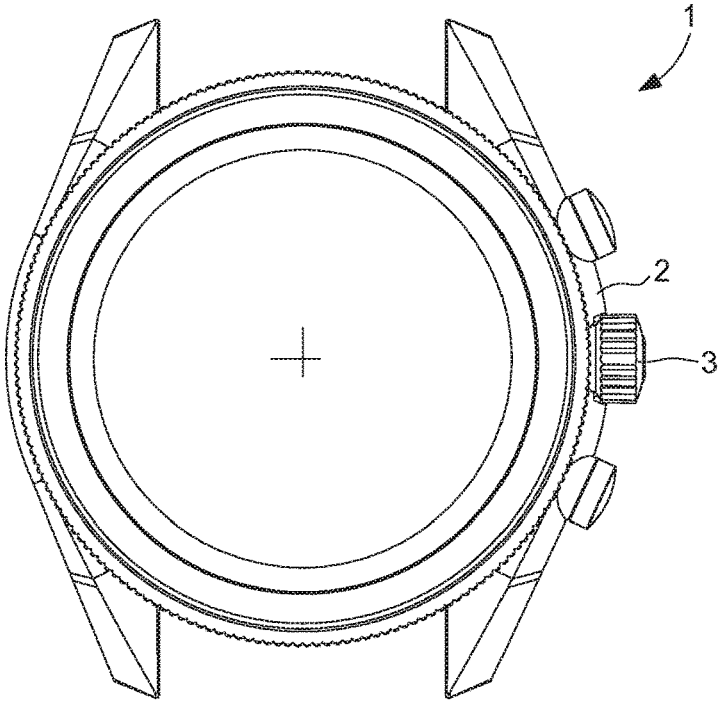
FIG. 1 represents a plan view of a timepiece provided with a crown/pusher according to the invention.
Figure 2:
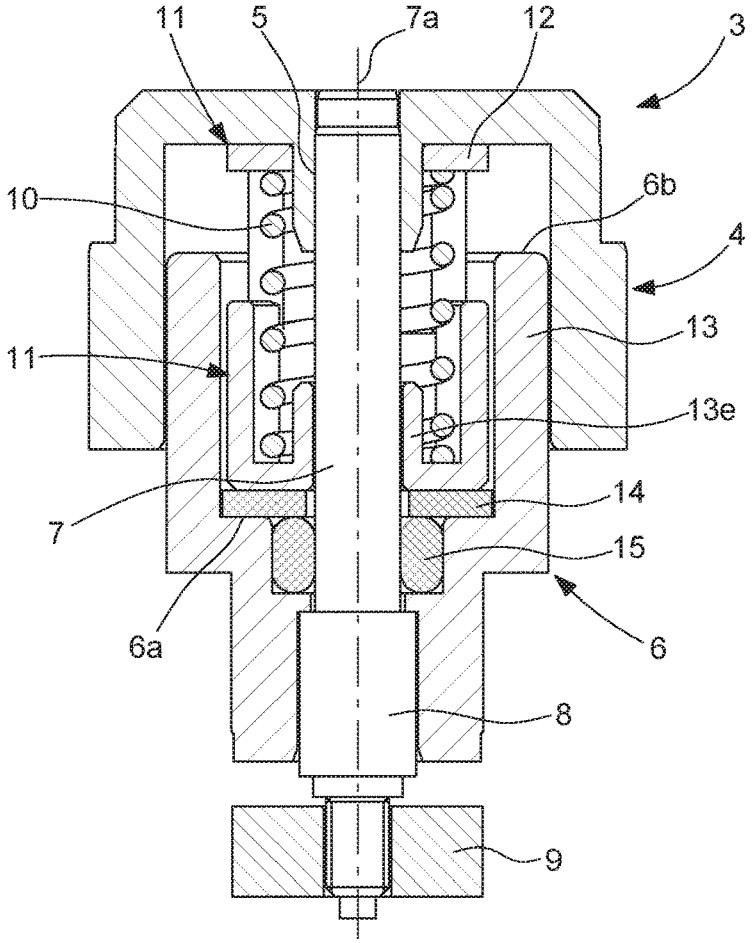
FIG. 2 represents a longitudinal sectional view of the crown/pusher according to the invention.

Referring to FIGS. 1 and 2, the timepiece comprises, in a conventional manner, a case 1 provided with a middle part 2 and a crown/pusher 3 comprising a recessed/hollowed head 4 integral with a stem 7 moving inside a tube 6 attached to the case middle. Tube 6 is traversed by stem 7 connected to recessed head 4. Recessed head 4 is mounted to move in translation and in rotation respectively along and around axis 7*a* of stem 7. According to the variant represented in FIG. 2 for an electronic watch, stem 7 is integral at its base with a retaining element 8. A magnet 9, for example a multipolar magnet, is attached to the distal end of stem 7 in order to cooperate with one or more sensors (not represented). For a mechanical watch, the stem can activate a function such as a chronograph function.

Crown/pusher 3 also includes a spring 10 arranged around stem 7. According to the invention, return spring 10 is compressed inside a cage 11 shown in more detail in FIG. 3. Cage 11 is disposed between tube 6 and stem 7. It bears at one axial end on an inner face of recessed head 4 and at its other axial end on a base 6*a* of tube 6 or, preferably, on a washer 14 which facilitates sliding, washer 14 being disposed on this same base 6*a*. Cage 11 is made in two distinct parts: upper part 12 and lower part 13, with upper part 12 integral with recessed head 4. To this end, upper part 12 is attached to a core 5 extending partially around stem 7 from the inner face of recessed head 4. The two upper and lower parts 12 and 13 cooperate, or in other words, interlock with each other. Upper part 12 of the cage rotates integrally with recessed head 4, while lower part 13 of the cage is axially free with respect to the recessed head but driven in rotation by the upper part of the cage during the rotation of the recessed head. Further, upper part 12 is mounted on lower part 13 in order to move in translation along axis 7*a* of stem 7 when the crown/pusher is pushed in. Different configurations can be envisaged to ensure the cooperation in rotation of the two parts and the movement in translation of the upper part with respect to the lower part. According to the variant of FIGS. 3 and 4*a*-4*c* described in more detail below, upper part 12 has at least one portion 12*f* interlocked in an opening 13*b* of lower part 13. By way of example, according to another variant that is not represented, the upper part can have at least one portion sliding inside a slide way arranged on an inner wall of the lower part.

Figure 3:
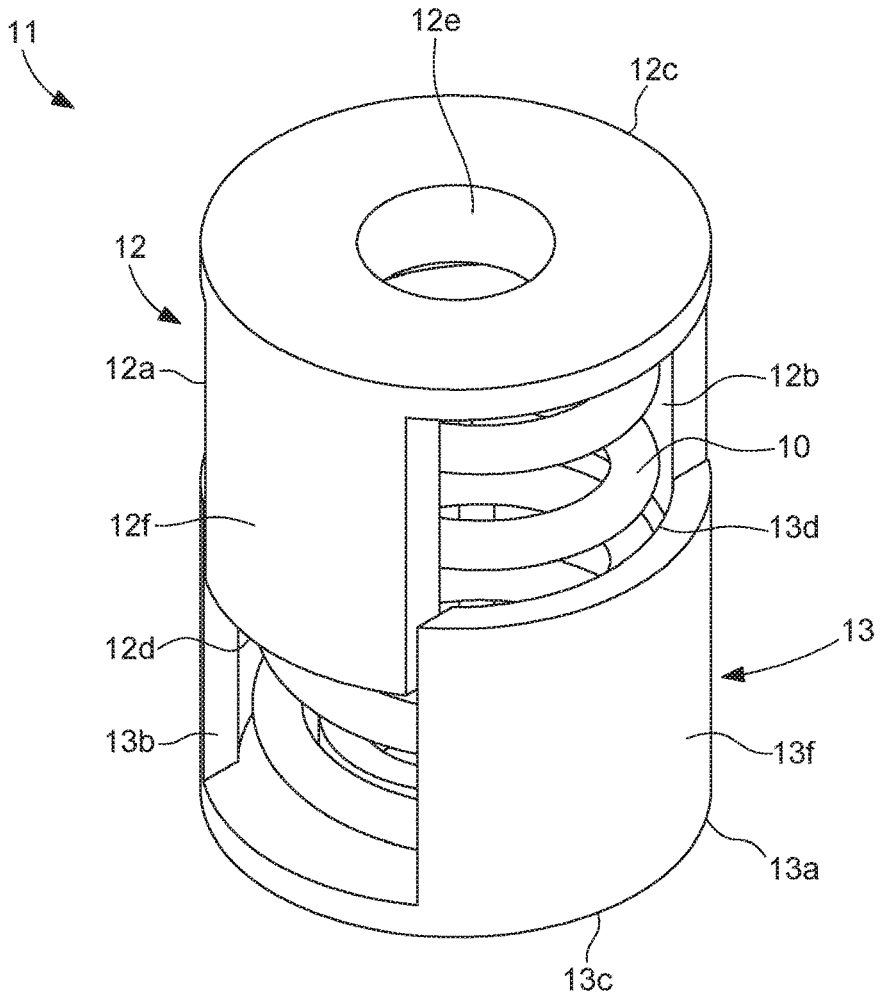
FIG. 3 represents a three-dimensional view of the spring cage according to the invention.
Figure 4A:
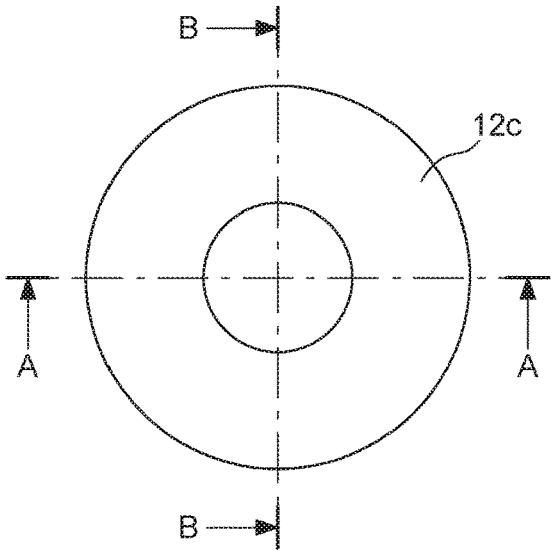
FIG. 4*a* represents a plan view of the spring cage according to the invention.
Figure 4B:
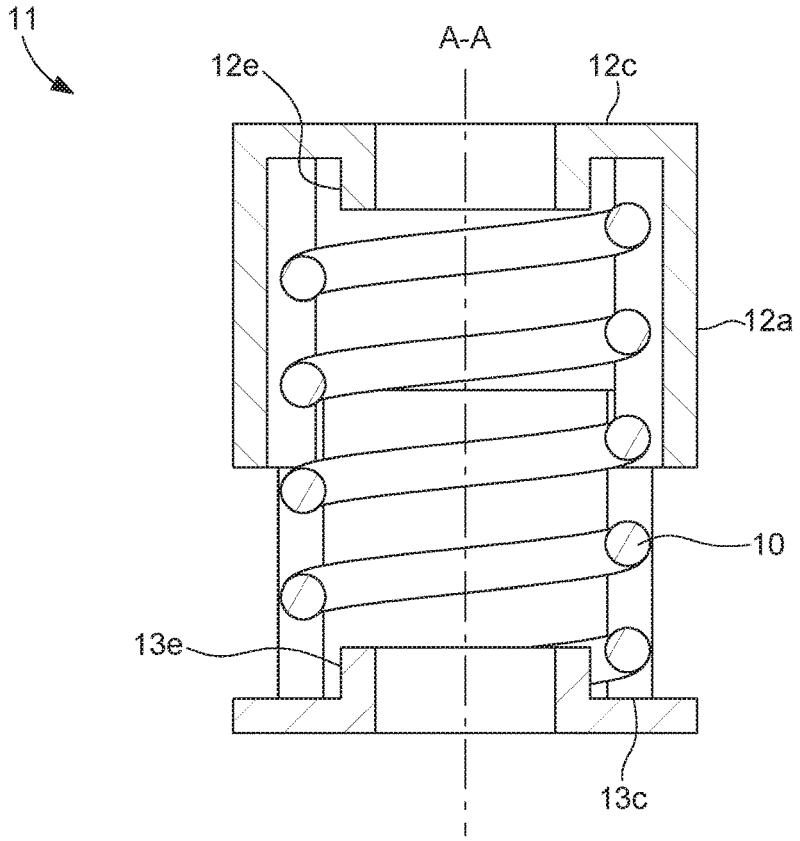
FIGS. 4*b* and 4*c* are respectively sectional views along axes A-A and B-B of FIG. 4*a*.
Figure 4C:
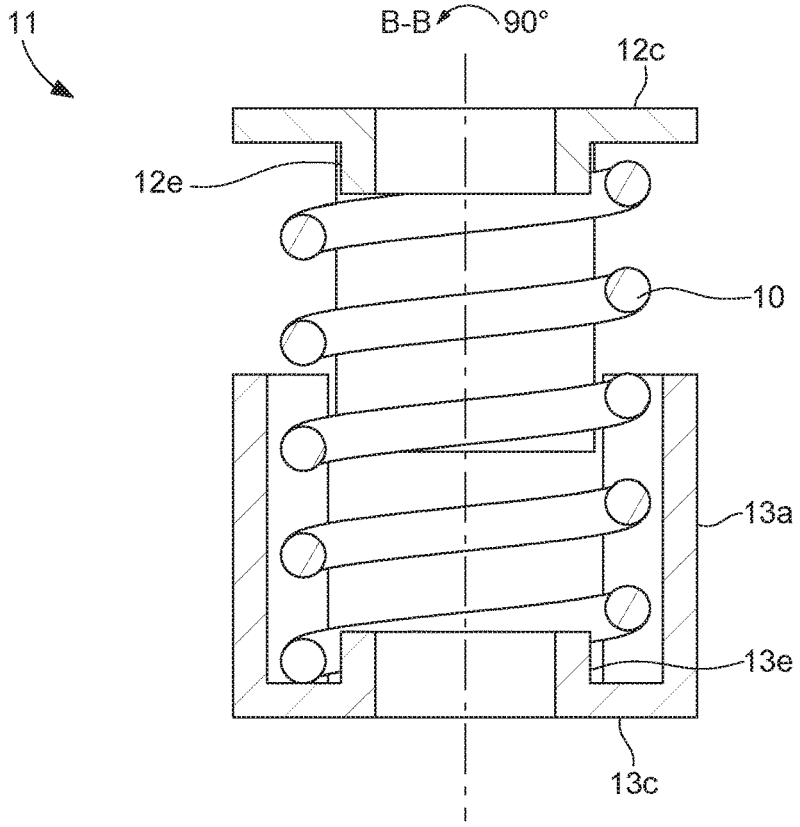
Figure 5B:
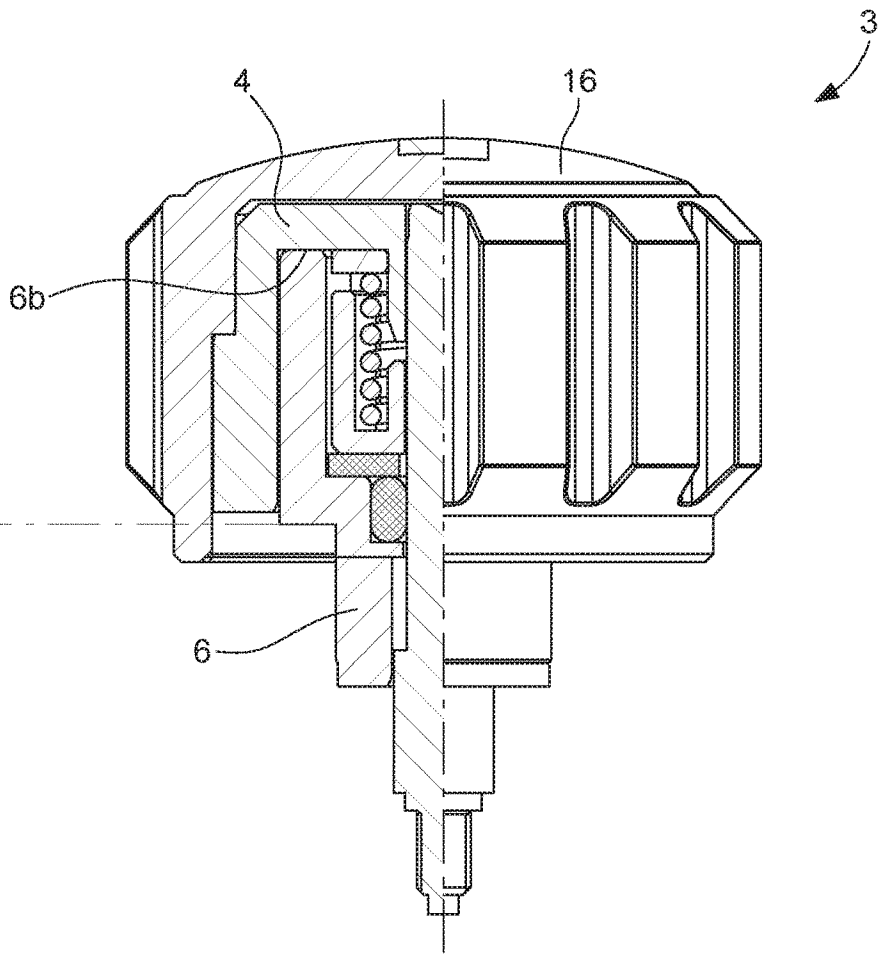
FIG. 5*b* represents the same view of the crown/pusher in the pressed-in position.
Figure 5A:
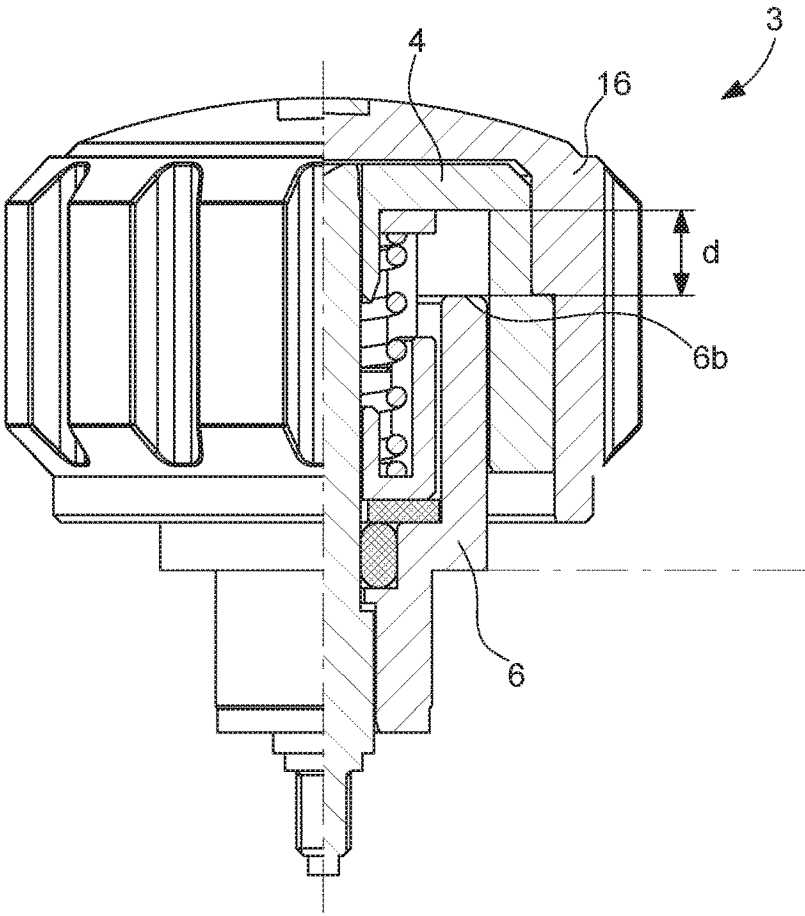
FIG. 5*a* is a longitudinal half-section of the crown/pusher according to the invention in the final position mounted in the timepiece.

Referring to the variant of FIGS. 3 and 4*a*-4*c*, each part 12, 13 has a cylindrical shape with a side wall 12*a*, 13*a* provided with at least one opening 12*b*, 13*b* and preferably two openings, or even three, four, etc. openings. Side wall 12*a*, 13*a* is delimited at one end by a base 12*c*, 13*c* pierced with a central hole and at the other end by a completely open base 12*d*, 13*d*. Openings 12*b*, 13*b* cut into side wall 12*a*, 13*a* define the contours of a 'U'. In the illustrated example, the openings, which are two in number, are diametrically opposite. Openings 12*b*, 13*b* are delimited by portions 12*f*, 13*f* of side wall 12*a*, 13*a*. Side wall 12*a*, 13*a* is thus formed of portions 12*f*, 13*f* flanked by openings 12*b*, 13*b*. According to the invention, the two parts 12, 13 are mounted in opposite directions with respect to each other, coaxially along stem 7 and with an angular shift of 90° with respect to one another. Thus, the open bases 12*d*, 13*d* face each other and portions 12*f* of side wall 12*a* of upper part 12 are interlocked in openings 13*b* of side wall 13*a* of lower part 13 in order, on the one hand, to allow the movement in translation of the upper part with respect to the lower part and, on the other hand, to allow the rotating upper part to drive the lower part in its movement. In the extended position of crown/pusher 3, as represented in FIGS. 2, 3 and 5*a*, portions 12*f* of side wall 12*a* of upper part 12 are slightly engaged in the respective openings 13*b* of lower part 13. In the pushed-in position of crown/pusher 3 as represented in FIG. 5*b*, portions 12*f* of side wall 12*a* are engaged more deeply in openings 13*b*. The maximum travel d represented in FIG. 5*a* is limited by the lower face of recessed head 4 abutting against edges 6*b* of tube 6.

Spring 10 is housed in cage 11 between the two bases pierced with central hole 12*c*, 13*c* in the space delimited by side walls 12*a*, 13*a* and the rim 12*e*, 13*e* of the central holes. During use, this arrangement allows the spring to be rotated with the case, which prevents premature wear caused by a relative movement between the spring and a rotating component.

KEY (1) Case
(2) Case middle
(3) Crown/pusher
(4) Recessed head
(5) Core
(6) Tube
a. Base
b. Edge
(7) Stem
a. Axis
(8) Retaining element
(9) Multipolar magnet
(10) Return spring
(11) Cage
(12) Upper part of the cage
a. Side wall
b. Opening
c. Base with a central hole
d. Open base
e. Rim of the central hole
f. Portion of the side wall
(13) Lower part of the cage
a. Side wall
b. Opening
c. Base with a central hole
d. Open base
e. Rim of the central hole
f. Portion of the side wall
(14) Washer
(15) Gasket
(16) Cap

The invention claimed is:

1. A crown/pusher comprising:

a tube configured to be fixed to a watch case, a recessed head integral with a stem extending into its recessed part, the stem defining an axis, said recessed head being mounted to move in rotation and in translation respectively around and along the axis of the stem, a return spring disposed around the stem, a cage housing the spring, said cage being traversed by the stem and comprising an upper part integral with the recessed head and a lower part freely mounted with respect to the recessed head, said upper part cooperating with the lower part in order to drive the lower part in its rotational movement and in order to move in translation along the axis with respect to said lower part, said spring being compressed inside the cage such that an upper end of the spring directly contacts the upper part of the cage and a lower end of the spring directly contacts the lower part of the cage in order to be driven in rotation with said cage.

2. The crown/pusher according to claim 1, wherein the upper part and the lower part have the same cylindrical shape such that the upper part and the lower part each include a side wall provided with at least one opening, the side wall being delimited at one end by a base pierced with a central hole and at the other end by a completely open base, the upper part and the lower part being mounted in opposite directions with respect to each other and coaxially around the stem with one portion of the side wall of the upper part being interlocked in an opening of the side wall of the lower part.

3. The crown/pusher according to claim 2, wherein the opening defines the contours of a U.

4. The crown/pusher according to claim 2, wherein two openings are in the upper part and in the lower part, the openings of each part being diametrically opposite with respect to the axis of the stem.

5. The crown/pusher according to claim 1, wherein the cage is attached in its upper part to a core extending from the inner face of the recessed head and arranged around the stem.

6. The crown/pusher according to claim 2, wherein the cage rests at one axial end on an inner face of the recessed head and at another axial end on a base of the tube.

7. The crown/pusher according to claim 6, wherein the inner face of the recessed head and the base respectively have a complementary shape to that of the pierced base of the central hole of the upper part and of the lower part in the bearing area.

8. The crown/pusher according to claim 6, comprising a washer facilitating sliding, said washer being arranged on the base of the tube.

9. The crown/pusher according to claim 8, wherein the inner face of the recessed head and the washer respectively have a complementary shape to that of the pierced base of the central hole of the upper part and of the lower part in the bearing area.

10. The crown/pusher according to claim 2, wherein the spring is housed in the cage between the two bases pierced with the central hole in the space delimited by the side walls and a rim of the central holes.

11. The crown/pusher according to claim 2, wherein the portion of the side wall of the upper part is partially engaged in the opening of the lower part when the recessed head is in the position thereof axially furthermost from the tube, the portion of the side wall of the upper part being more deeply engaged in the opening of the lower part when the recessed head is in the position thereof axially closest to the tube.

12. A timepiece comprising:

the crown/pusher according to claim 1.

13. A crown/pusher comprising:

a cage housing a spring, said cage being traversed by a stem and comprising an upper part integral with the recessed head and a lower part freely mounted with respect to the recessed head, said upper part cooperating with the lower part in order to drive the lower part in its rotational movement and in order to move in translation along the axis with respect to said lower part, said spring being compressed inside the cage such that an upper end of the spring directly contacts the upper part of the cage and a lower end of the spring directly contacts the lower part of the cage in order to be driven in rotation with said cage.

14. The timepiece according to claim 12, wherein the timepiece is an electronic or mechanical watch.

* * * * *